US009268298B2

(12) United States Patent
Hamada et al.

(10) Patent No.: US 9,268,298 B2
(45) Date of Patent: Feb. 23, 2016

(54) PROCESS CARTRIDGE AND IMAGE FORMING APPARATUS

(71) Applicants: Daisuke Hamada, Kanagawa (JP); Jun Shiori, Kanagawa (JP); Hideo Yoshizawa, Kanagawa (JP); Natsumi Matsue, Kanagawa (JP); Shingo Kuboki, Kanagawa (JP)

(72) Inventors: Daisuke Hamada, Kanagawa (JP); Jun Shiori, Kanagawa (JP); Hideo Yoshizawa, Kanagawa (JP); Natsumi Matsue, Kanagawa (JP); Shingo Kuboki, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/632,536

(22) Filed: Feb. 26, 2015

(65) Prior Publication Data

US 2015/0248107 A1 Sep. 3, 2015

(30) Foreign Application Priority Data

Feb. 28, 2014 (JP) ..... 2014-039179

(51) Int. Cl.
*G03G 21/18* (2006.01)

(52) U.S. Cl.
CPC ..... *G03G 21/1803* (2013.01); *G03G 21/1821* (2013.01); *G03G 21/1857* (2013.01); *G03G 2221/1657* (2013.01)

(58) Field of Classification Search
CPC ..... G03G 21/1803; G03G 21/1857; G03G 2221/163; G03G 2221/18; G03G 2221/1807; G03G 21/1821; G03G 2221/1657
USPC ..... 399/111, 113
See application file for complete search history.

(56) References Cited

U.S. PATENT DOCUMENTS

| | | | | |
|---|---|---|---|---|
| 4,128,079 | A * | 12/1978 | Suzuki | 399/116 |
| 2006/0029435 | A1 | 2/2006 | Kasai et al. | |
| 2006/0039717 | A1* | 2/2006 | Hatori | 399/111 |
| 2011/0026958 | A1 | 2/2011 | Shiori | |
| 2012/0045235 | A1 | 2/2012 | Shiori et al. | |
| 2012/0230738 | A1 | 9/2012 | Yoshizawa et al. | |
| 2013/0064570 | A1 | 3/2013 | Yamane et al. | |
| 2013/0164028 | A1* | 6/2013 | Morioka et al. | 399/111 |
| 2013/0243478 | A1* | 9/2013 | Okamoto et al. | 399/111 |

FOREIGN PATENT DOCUMENTS

| | | |
|---|---|---|
| JP | 2007-047720 | 2/2007 |
| JP | 2013-068929 | 4/2013 |

* cited by examiner

*Primary Examiner* — Sophia S Chen
(74) *Attorney, Agent, or Firm* — Harness, Dickey & Pierce, P.L.C.

(57) ABSTRACT

A process cartridge is detachably mounted on an apparatus main body of an image forming apparatus. An embodiment of the cartridge includes a developer bearer arranged to be opposed to an image bearer in a developing device and rotates; a positioning member that supports the image bearer and the developer bearer at respective ends thereof, and fixes a distance between rotating shafts of the image bearer and the developer bearer; a rotating shaft arranged on a rotating member arranged on the developing device, and having a part protruding from an outer surface of a housing frame of the process cartridge; a gear that is arranged at a distal end of the rotating shaft and transmits a rotational driving force transmitted from the apparatus main body; and a bearing that is arranged between the positioning member and the gear, is fixed to the housing frame, and supports the rotating shaft.

10 Claims, 9 Drawing Sheets

PROCESS CARTRIDGE AND IMAGE FORMING APPARATUS

CROSS-REFERENCE TO RELATED APPLICATIONS

The present application claims priority to and incorporates by reference the entire contents of Japanese Patent Application No. 2014-039179 filed in Japan on Feb. 28, 2014.

BACKGROUND OF THE INVENTION

1. Field of the Invention

The present invention relates to a process cartridge detachably installed in an image forming apparatus such as a copying machine, a printer, a facsimile, and a plotter, or such as a multifunction peripheral having a plurality of these functions, and also relates to the image forming apparatus.

2. Description of the Related Art

In image forming apparatuses such as a copying machine, a printer, a facsimile, and a plotter, or such as a multifunction peripheral having a plurality of these functions, an electrostatic latent image formed on a photoconductor serving as an image bearer or a latent image bearer is subjected to visualization processing using toner in a developer supplied from a developing device. A toner image subjected to visualization processing is transferred to a recording sheet and the like serving as a sheet recording medium and is further subjected to fixing processing to be output as a copy. The developing device used for visualization processing of the electrostatic latent image may be configured to use a one-component developer including only toner. In addition, the developing device may be configured to use a two-component developer including toner and a carrier.

Known examples of the developing device using the two-component developer include a magnetic brush developing device configured such that a magnetic brush is formed on a surface of a developing sleeve serving as a developer bearer incorporating a plurality of magnetic poles by causing the toner in the two-component developer to adhere to a magnetic carrier to be napped. The developing sleeve supporting the magnetic brush on the surface thereof rotates to cause the toner on the supported magnetic brush to be brought into contact with an electrostatic latent image formed on a surface of the photoconductor serving as a latent image bearer. With this configuration, the toner in the developer is transferred to the electrostatic latent image by electrostatic attraction caused between the toner and the electrostatic latent image. Hereinafter, the developing sleeve may also be referred to as a "developing roller". Accordingly, the developing roller functions as the developer bearer.

In a two-component developing process, regarding a toner amount scooped by the developing sleeve for causing a desired amount of toner to adhere to the photoconductor, it has been known that accuracy of a distance between the developing sleeve and the photoconductor set to cause the toner to electrostatically adhere to the photoconductor is important.

The distance between the developing sleeve and the photoconductor is often fixed by a pitch in front and rear face plates arranged as positioning members for positioning a developing roller shaft and a photoconductor shaft in a process cartridge, and is well-known as conventional art.

As to the process cartridge, known is a process cartridge of a cantilever support in which a rotating shaft of a rotating member such as a conveying screw that rotationally conveys the developer protrudes from an outer surface of a housing of the process cartridge and a gear is attached to a distal end of the protruding rotating shaft (for example, refer to FIGS. 5 and 8 in Japanese Patent Application Laid-open No. 2007-047720).

In the process cartridge described above (hereinafter, simply referred to as a "cartridge" in some cases), when the cartridge is mounted on an apparatus main body, the gear meshes with a drive input gear or the like to which a rotational driving force is transmitted from the apparatus main body so as to be rotationally driven. Such a cartridge having the configuration as described above is of a cantilever support type in which the distal end of the protruding rotating shaft is not supported, so that a space in the longitudinal direction (rotating shaft direction) of the cartridge is advantageously secured, which is appropriate for reducing the size of the apparatus.

However, on the front and the rear face plates that couple a photoconductor unit and a developing unit, it is preferable that the developing roller shaft, the photoconductor shaft, and a portion that fixes a posture of the cartridge are on the same plane in terms of accuracy of components and/or the like. For example, driving components such as a gear are inside the face plates (for example, refer to FIG. 8 in Japanese Patent Application Laid-open No. 2007-047720), the face plates should be correspondingly shifted to the outside in the entire area, so that the corresponding space is occupied and the size of the apparatus is undesirably increased.

In view of such a situation, there is a need to provide a process cartridge for preventing the size of the apparatus from increasing.

SUMMARY OF THE INVENTION

It is an object of the present invention to at least partially solve the problems in the conventional technology.

A process cartridge includes at least an image bearer and a developing device among the image bearer, a charging device, the developing device, and a cleaning device in an integral manner, and is detachably mounted on an apparatus main body of an image forming apparatus. The process cartridge includes: a developer bearer that is arranged to be opposed to the image bearer in the developing device and rotates in a certain direction while bearing a developer; a positioning member that supports the image bearer and the developer bearer at respective ends thereof in a rotating shaft direction in a rotatable manner, and fixes a distance between a rotating shaft of the image bearer and a rotating shaft of the developer bearer; a rotating member arranged on the developing device; a rotating shaft arranged on the rotating member, and having a part in a longitudinal direction protruding from an outer surface of a housing frame of the process cartridge; a gear that is arranged at a distal end of the protruding rotating shaft and transmits a rotational driving force transmitted from the apparatus main body to the rotating member; and a bearing that is arranged between the positioning member and the gear, that is fixed to the housing frame, and that supports the rotating shaft in a rotatable manner.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
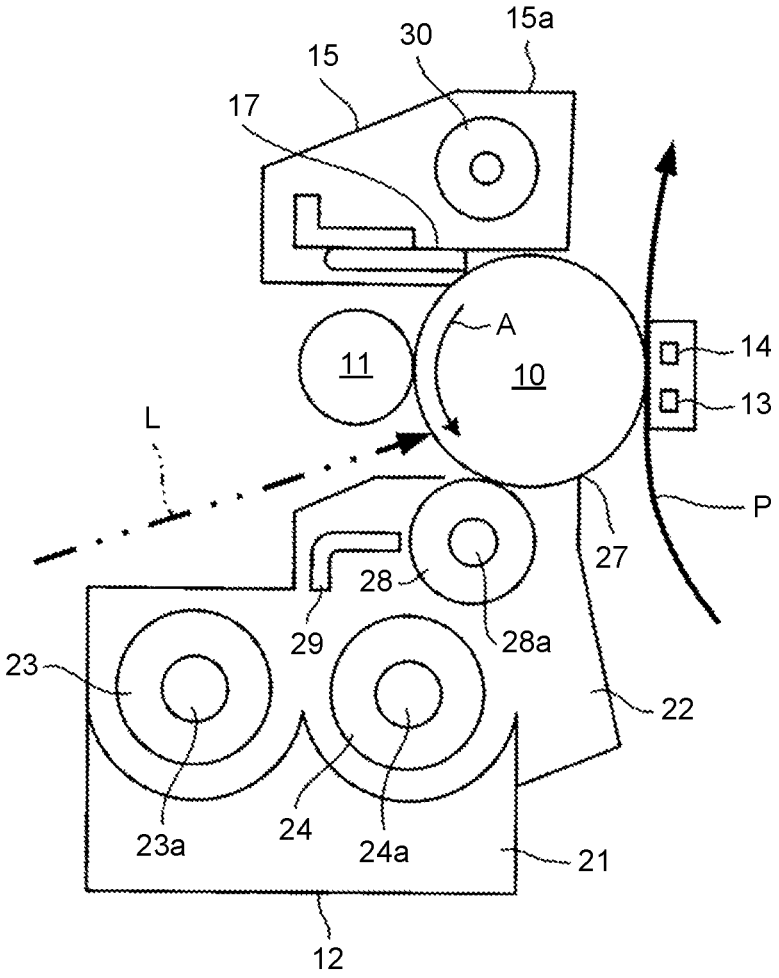
FIG. 1 is a schematic configuration diagram illustrating a principal part of an image forming unit in an image forming apparatus according to an embodiment of the present invention.

The following describes an embodiment of the present invention including examples in detail with reference to the drawings. Through all embodiments, constituent elements (members or components) and the like having the same function and the same shape are denoted by the same reference numeral and description thereof will not be repeated after once explained unless they may cause confusion. To clarify the drawings and explanation, even a constituent element that is to be illustrated in the drawing may be appropriately omitted without any particular remarks when specific description of the constituent element is not required in that drawing. When a constituent element in a published unexamined patent application is cited for explanation, a reference numeral thereof is put in parentheses so as to be distinguished from the constituent elements in the embodiments and the like.

FIG. 1 is a schematic configuration diagram illustrating a principal part of an image forming unit in an image forming apparatus according to the embodiment of the present invention. Around a drum-shaped photoconductor 10 serving as an image bearer, arranged are a developing device 12 thereunder, a transferring device 13 and a sheet separating device 14 at the right thereof, and a cleaning device 15 over that, sequentially from a roller-shaped charging device 11 arranged on the left in the drawing toward a rotational direction of the photoconductor 10 indicated by an arrow A.

Figure 2:
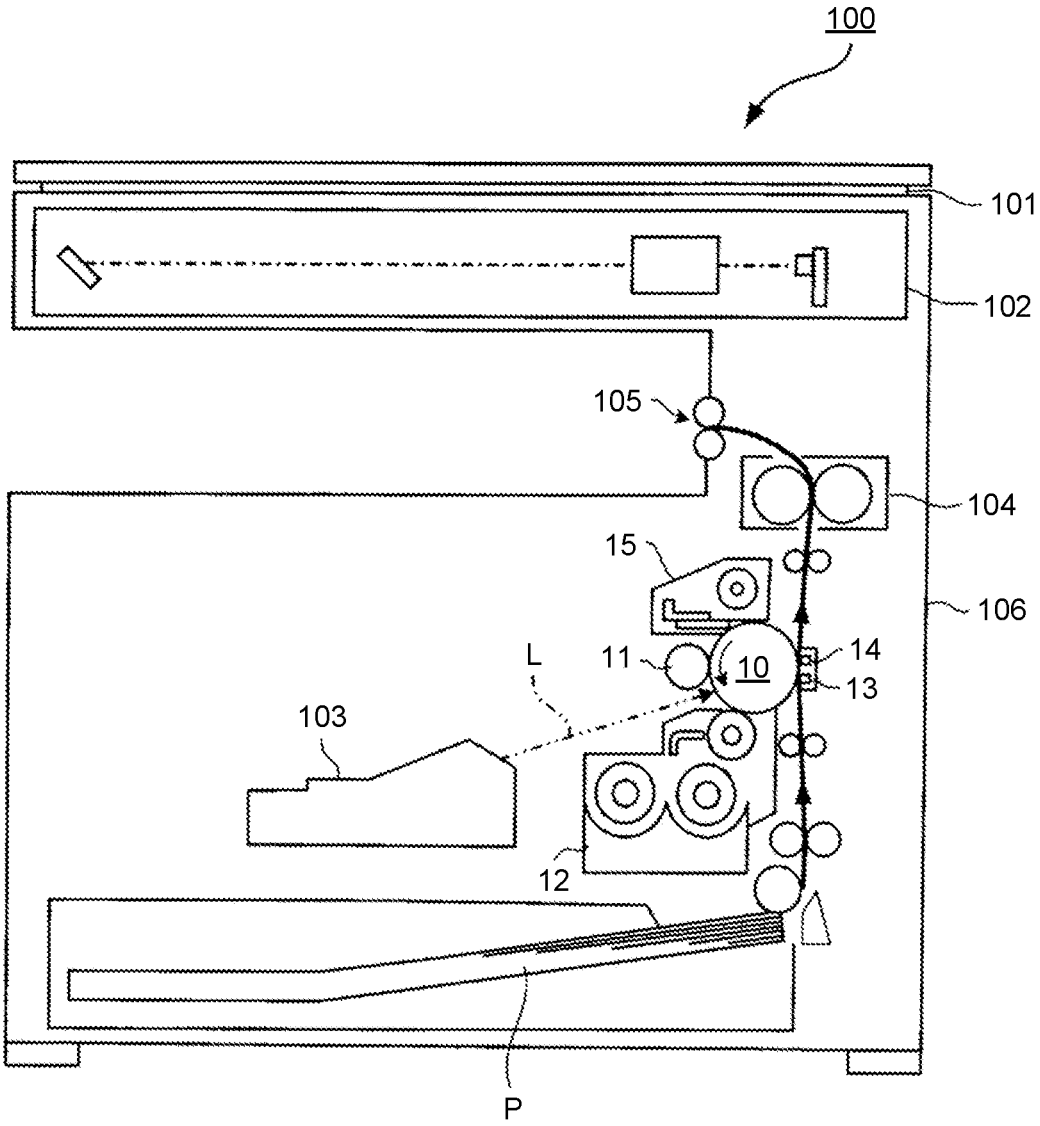
FIG. 2 is a schematic configuration diagram of the image forming apparatus including a developing device.

FIG. 2 is a schematic configuration diagram of an image forming apparatus 100 including the developing device 12. In FIG. 2, the front of the drawing corresponds to the front where a user performs attaching and detaching operations of an operation unit, a sheet feeding cassette, or a process cartridge 20 illustrated in FIGS. 3 to 5, for example. The rear of the drawing corresponds to the rear where a driving mechanism that transmits driving from a main body of the image forming apparatus 100 to the process cartridge 20, and the like are arranged.

As well known in the art, to copy an original by the image forming apparatus 100, the original is set on a contact glass 101 and a start button (not illustrated) is pressed. An optical reading device 102 then reads an image on the original, and a sheet P serving as a recording medium is fed upward between the photoconductor 10 and the transferring device 13 as indicated by the arrow in the drawing at the same time.

On the other hand, the photoconductor 10 is rotationally driven by a driving module (not illustrated), and the surface thereof is uniformly charged by the charging device 11 along with the rotation. An optical writing device 103 irradiates the charged surface with a laser beam L to perform writing. Accordingly, an electrostatic latent image corresponding to the read original image is formed on the surface of the photoconductor 10. When passing through a position opposite to the developing device 12, the photoconductor 10 receives toner in a developer (two-component developer) including the toner and carriers supplied from the developing device 12, so that the toner adheres to the electrostatic latent image to be sequentially visualized. As described above, the visualized toner image is transferred, by the transferring device 13, to the sheet P fed to between the photoconductor 10 and the transferring device 13.

After being transferred, the sheet P is discharged by the sheet separating device 14 to be separated from the photoconductor 10 electrostatically adhering thereto, conveyed to a fixing device 104 by which the transferred image is fixed, and ejected to a paper ejection unit 105. The sheet P may be mechanically separated from the photoconductor 10 by providing a separation claw instead of the sheet separating device 14. The surface of the photoconductor 10 after transferring the image is cleaned by scraping off residual toner and the like remaining on the surface thereof with a cleaning blade 17 illustrated in FIG. 1 included in the cleaning device 15. Thereafter, static charges are removed from the photoconductor 10 by a discharging lamp (not illustrated) to initialize surface potential thereof.

Figure 3A:
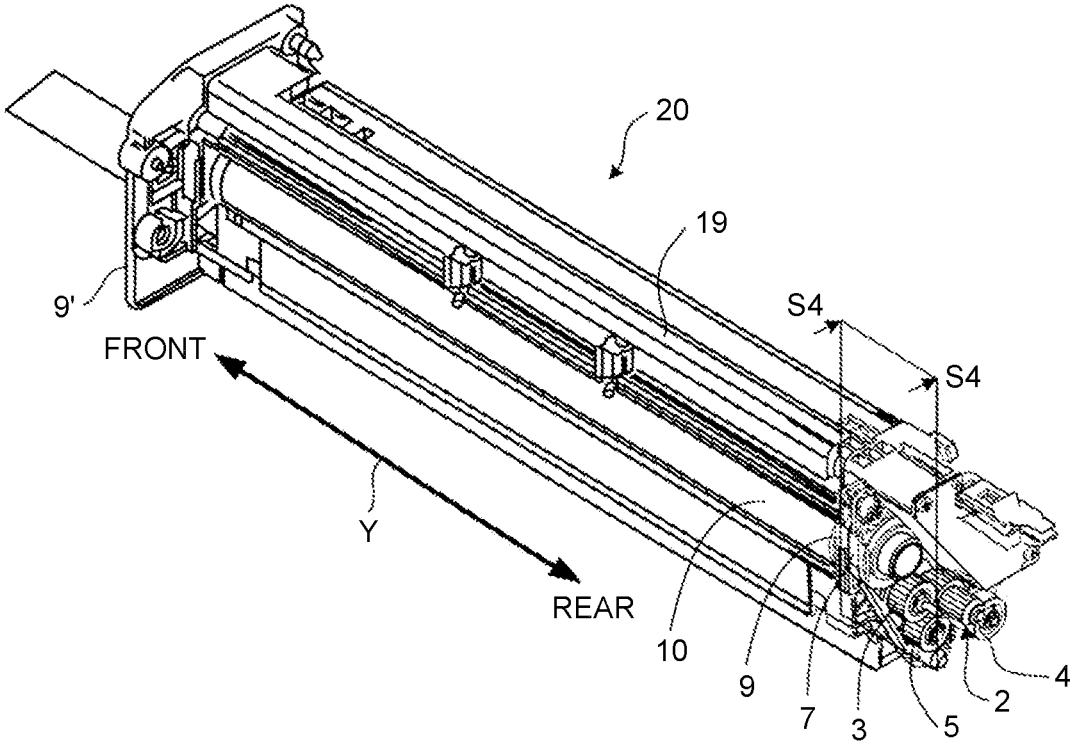
FIG. 3A is a perspective view of a process cartridge viewed from the rear of the image forming apparatus.
Figure 3B:
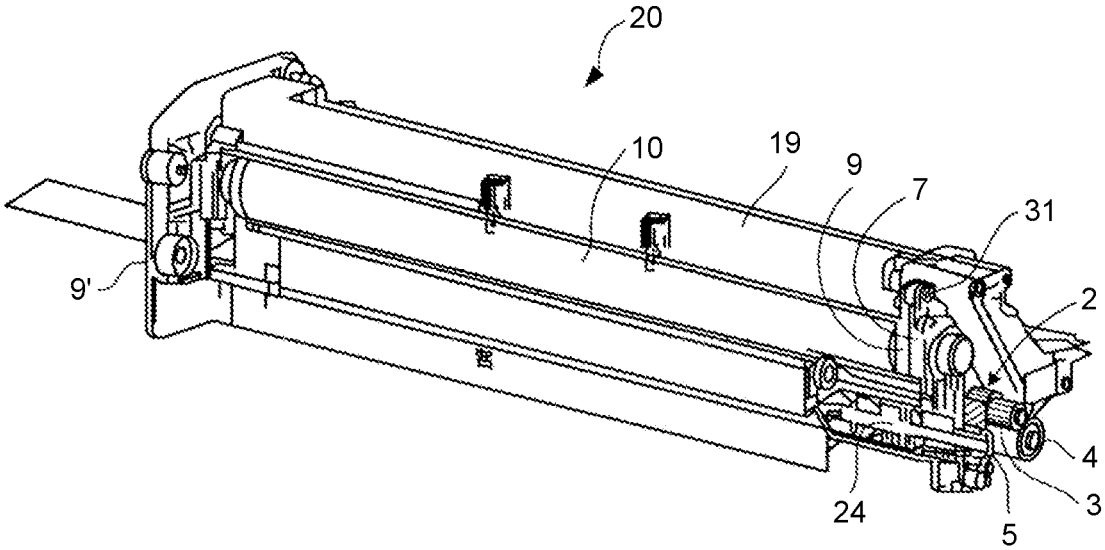
FIG. 3B is a partial sectional view illustrating the process cartridge in FIG. 3A with part close to the rear end thereof sectioned.
Figure 4:
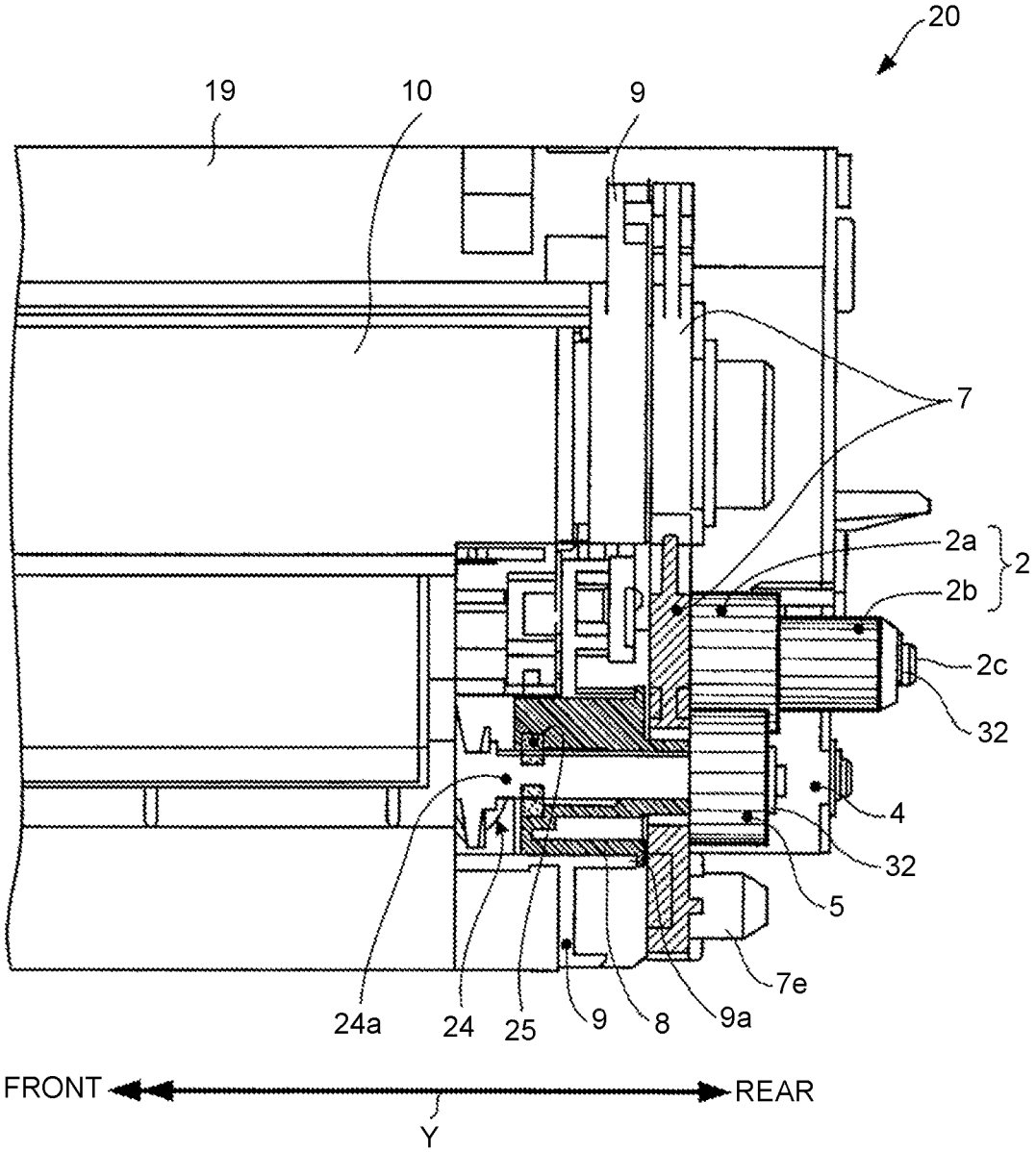
FIG. 4 is an enlarged sectional view along S4-S4 of the process cartridge in FIG. 3A.

In the image forming apparatus 100, as illustrated in FIGS. 3 and 4 described later, the process cartridge 20 is configured to include the photoconductor 10, the charging device 11, the developing device 12, and the cleaning device 15 integrally housed in one cartridge case 19 serving as a housing frame. The process cartridge 20 is detachably mounted on an apparatus main body 106 of the image forming apparatus 100 via a well-known attaching/detaching module (not illustrated) arranged on the apparatus main body 106 and the cartridge case 19.

The process cartridge 20 is not limited to the one described above. The process cartridge 20 may include at least the photoconductor 10 and the developing device 12 in an integral manner, and may be detachably mounted on the apparatus main body 106. The present invention can also be applied to an image forming apparatus with the photoconductor 10, the charging device 11, the developing device 12, the cleaning device 15, and the like being arranged in the apparatus main body 106 instead of constituting the process cartridge 20.

Figure 5:
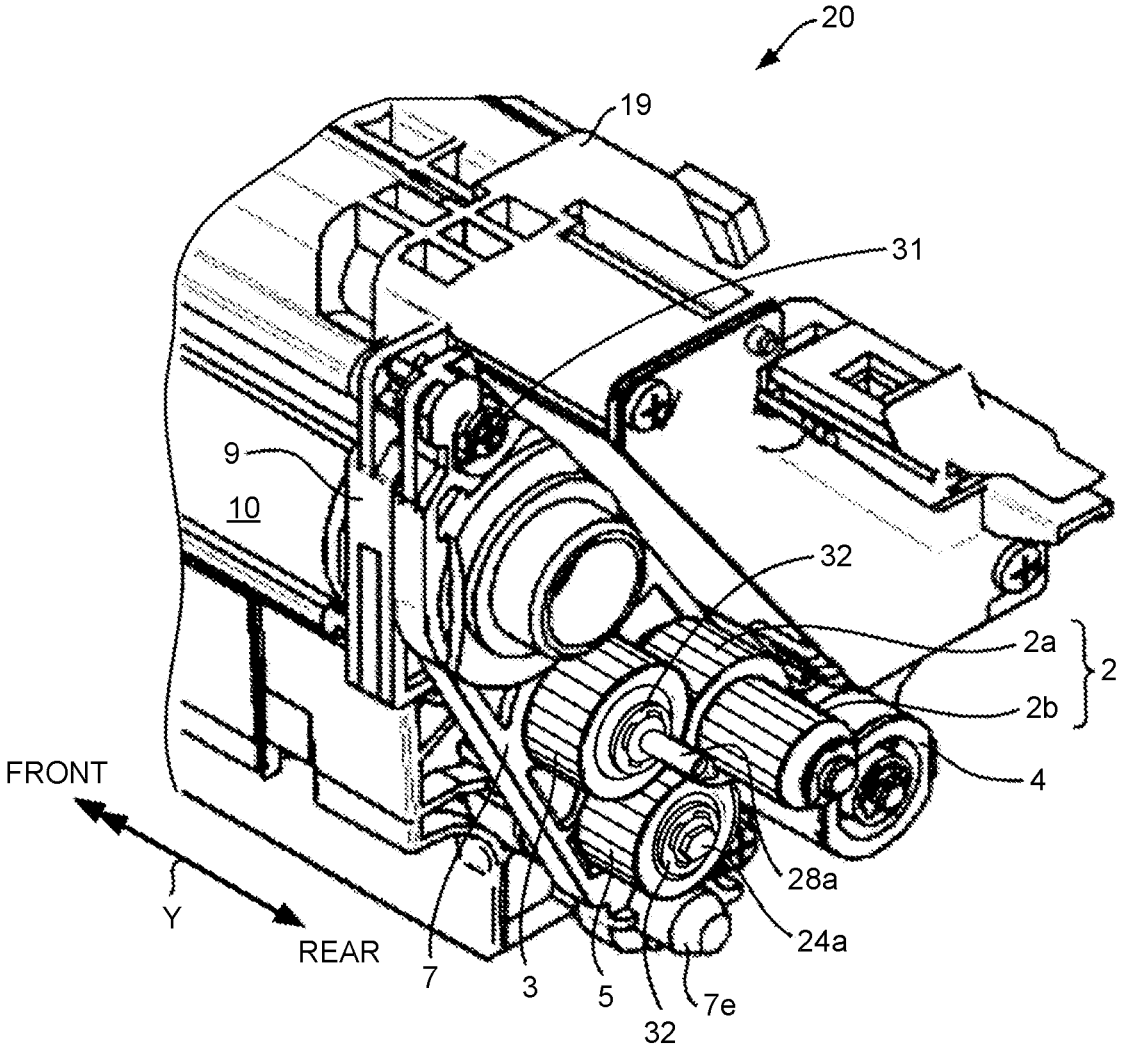
FIG. 5 is an enlarged perspective view around the rear end of the process cartridge in FIG. 3A.

FIG. 3A is a perspective view of the process cartridge 20 viewed from the rear of the image forming apparatus 100. FIG. 3B is a partial sectional view illustrating the process cartridge 20 in FIG. 3A with part close to the rear end thereof sectioned. FIG. 4 is an enlarged sectional view along S4-S4 of the process cartridge 20 in FIG. 3A. FIG. 5 is an enlarged perspective view around the rear end of the process cartridge 20 in FIG. 3A. In FIGS. 3 to 5, Y indicates the front and rear direction of the process cartridge 20 (the longitudinal direction or rotating shaft direction of the photoconductor 10).

The process cartridge 20 is mounted between side plates (not illustrated) arranged at the front and the rear being opposed to each other in the apparatus main body 106 of the image forming apparatus 100 and is detachably set. The process cartridge 20 includes the cartridge case 19 that houses the photoconductor 10, the charging device 11, the developing device 12, and the cleaning device 15. A pair of cartridge frames 9 serving as a housing frame of the process cartridge is arranged at the front and the rear ends of the cartridge case 19.

As illustrated in FIG. 1, in the developing device 12 of the image forming apparatus 100, a developer stirring unit 21 is arranged at the lower of the device and a developer bearing unit 22 is arranged at the upper thereof. In the developer stirring unit 21, a first conveying screw 23 and a second conveying screw 24 are arranged as a rotating member and a conveying member that rotationally convey the two-component developer including the toner and the carriers while stirring them.

The first conveying screw 23 and the second conveying screw 24 also function as stirring members. Although not illustrated, a toner density sensor is also arranged for detecting a mixing ratio between the toner and the carriers in the developer from magnetic permeability, for example.

As illustrated in FIG. 1, the developer bearing unit 22 includes a developing roller 28 serving as a developer bearer arranged at a position opposite to the photoconductor 10 through a developing window 27, and a developing doctor 29 that controls an amount of the developer supplied to the photoconductor 10. In the developer bearing unit 22, the developing roller 28 bears the developer fed from the developer stirring unit 21 through an opening (not illustrated), then the developer is uniformized with the developing doctor 29 and the toner in the uniformized developer is rotated in a certain direction to adhere to the photoconductor 10.

In the cleaning device 15 arranged at a periphery of the photoconductor 10, a screw-shaped toner conveying member 30 that conveys the residual toner scraped off with the cleaning blade 17 is arranged in the axial direction of the photoconductor 10 in a cleaning case unit 15*a* of the cartridge case 19.

In a developing process, a driving motor (not illustrated) is activated to transmit the driving to rotate the developing roller 28 in FIG. 1 and rotate the first conveying screw 23 and the second conveying screw 24 to stir the developer so that the toner and the carriers are conveyed to the developing roller 28 while being frictionally charged. On the other hand, a predetermined developing bias is applied to the developing roller 28, and the toner in the developer electrostatically adheres to the surface of the photoconductor 10 to visualize a latent image on the surface.

As described above, in a two-component development, regarding a toner amount scooped by the developing roller 28 (developing sleeve) for causing a desired amount of toner to adhere to the photoconductor 10, accuracy of a distance between the developing roller 28 and the photoconductor 10 for causing the toner to electrostatically adhere to the photoconductor 10 is important. The distance between the developing roller 28 and the photoconductor 10 (developing gap) is fixed by a pitch in positioning members arranged at both ends in the rotating shaft direction of the photoconductor 10 and the developing roller 28 for positioning a rotating shaft 28*a* of the developing roller 28 and the rotating shaft of the photoconductor 10. Accordingly, to obtain high image quality and secure image density, a gap (developing gap) that is the distance between the developing roller 28 (developing sleeve) and the photoconductor 10 needs to be kept narrow in an accurate manner. The developing gap that is the distance between the developing roller 28 (developing sleeve) and the photoconductor 10 varies depending on target image quality, and set to about 0.1 to 0.5 mm.

Figure 6B:
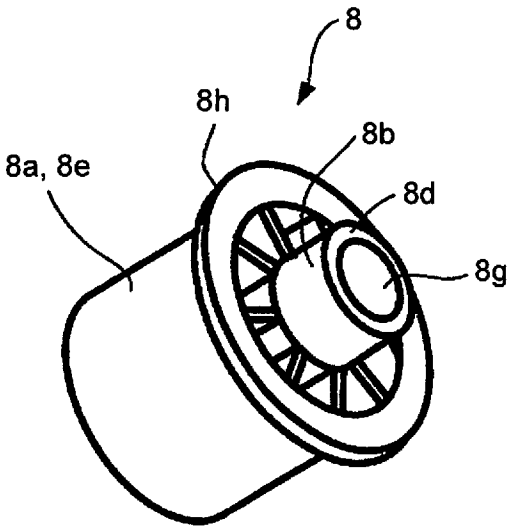
FIG. 6B is an external appearance perspective view of the bearing.
Figure 6A:
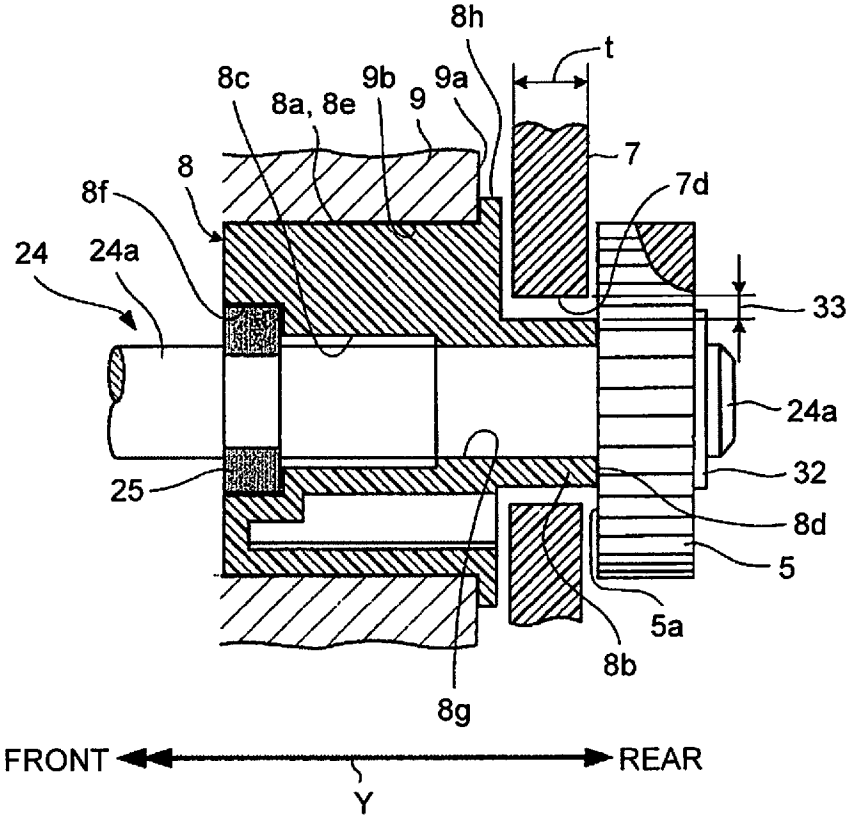
FIG. 6A is an enlarged sectional view illustrating an arranging/mounting relation among a face plate, a bearing, a rotating shaft of a second conveying screw, a second conveying screw gear, and a cartridge frame.
Figure 7:
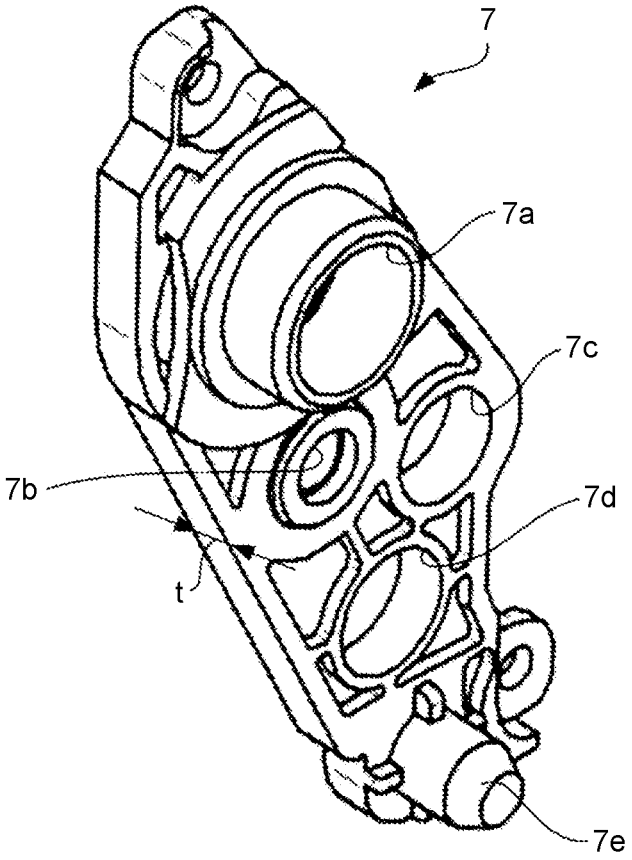
FIG. 7 is an external appearance perspective view of the face plate.

Next, the following describes a feature of the present invention with reference to FIGS. 3 to 7. FIG. 5 is an enlarged perspective view around the second conveying screw 24 in the rear end of the process cartridge 20 illustrated in FIG. 4. FIG. 6A is an enlarged sectional view illustrating an arranging/mounting relation among a face plate 7, a bearing 8, a rotating shaft 24*a* of the second conveying screw 24, a second conveying screw gear 5, and the cartridge frame 9. FIG. 6B is an external appearance perspective view of the bearing 8. FIG. 7 is an external appearance perspective view of the face plate 7.

As illustrated in FIG. 1 and FIGS. 4 to 6B, the first conveying screw 23 and a rotating shaft 23*a*, and the second conveying screw 24 and the rotating shaft 24*a*, are integrally formed with appropriate resin, and contribute to reduce weight and cost. Part of the rotating shaft 24*a* of the second conveying screw 24 in the front and rear direction Y (the right in the drawing) protrudes from an outer surface 9*a* that is an outer surface of the cartridge frame 9. The second conveying screw gear 5 serving as a conveying member gear is attached and fixed to a distal end that is one end of a protruding part of the rotating shaft 24*a*. In the second conveying screw gear 5, the rotating shaft 24*a* is positioned and prevented from slipping out in the front and rear direction Y with a retaining ring 32 mounted on the rotating shaft 24*a*. Accordingly, when a rotational driving force is transmitted to the second conveying screw gear 5, the second conveying screw gear 5 rotates together with the rotating shaft 24*a*.

A first conveying screw gear (not illustrated) is arranged at the front end of the rotating shaft 23*a* of the first conveying screw 23, and a second conveying screw gear (not illustrated) is arranged at the front end of the rotating shaft 24*a* of the second conveying screw 24. The first conveying screw 23 and the second conveying screw 24 are configured to rotate in the same rotational direction by each of the first conveying screw gear and the second conveying screw gear meshing with an idler gear (not illustrated) arranged at the front end of the process cartridge 20. In FIGS. 3 and 4, a reference numeral 4 denotes a bearing of the rotating shaft 23*a* of the first conveying screw 23.

A main body input gear shaft 2*c* is attached and fixed to the outer surface of the cartridge frame 9 in the vicinity of the rotating shaft 24*a* of the second conveying screw 24, the main body input gear shaft 2*c* being formed of metals such as steel materials and supporting a main body input gear 2 in a rotatable manner. The main body input gear 2 includes a large-diameter gear 2*a* and a small-diameter gear 2*b* that are integrally molded from appropriate resin. In the main body input gear 2, the main body input gear shaft 2*c* is positioned and prevented from slipping out in the front and rear direction Y with the retaining ring 32 mounted on the main body input gear shaft 2*c*. When the process cartridge 20 is mounted and set on the apparatus main body 106 and occupies a mounting position, the main body input gear 2 meshes with a driving gear (not illustrated) that transmits the rotational driving force transmitted from a driving source such as a motor (not illustrated) of the apparatus main body 106.

On the other hand, the rotating shaft 28*a* of the developing roller 28 is made of metal such as steel materials, protrudes from the outer surface of the cartridge frame 9 without interfering with the cartridge frame 9, and is supported by the face plate 7 described later in a rotatable manner. A developing roller gear 3 that always meshes with the large-diameter gear 2*a* of the main body input gear 2 is attached and fixed to the distal end of the rotating shaft 28*a*. In the developing roller gear 3, the rotating shaft 28*a* is positioned and prevented from slipping out in the front and rear direction Y with the retaining ring 32 mounted on the rotating shaft 28*a*. The second conveying screw gear 5 always meshes with the large-diameter gear 2*a* of the main body input gear 2.

The main body input gear 2, the developing roller gear 3, and the second conveying screw gear 5 are formed of appropriate resin and contribute to reduce weight and cost.

As described above, when the process cartridge 20 is mounted and set on the apparatus main body 106 and occupies the mounting position, a driving gear (not illustrated) of the apparatus main body 106 meshes with the small-diameter gear 2*b* of the main body input gear 2, and the rotational driving force is transmitted from the apparatus main body 106. At the same time, the developing roller gear 3 meshing with the large-diameter gear 2*a* of the main body input gear 2 is rotationally driven, so that the developing roller 28 is rotated in a certain direction. Simultaneously, the second conveying screw gear 5 meshing with the small-diameter gear 2*b* of the main body input gear 2 is rotationally driven, so that the second conveying screw 24 is rotated. The first conveying screw 23 is also rotated in the same rotational direction as that of the second conveying screw 24 via the idler gear.

The face plate 7 is fastened and fixed to the outer surface 9*a* of the cartridge frame 9 using a screw 31. A face plate (not illustrated) substantially similar to the face plate 7 is fastened and fixed to an outer surface of a cartridge frame 9' at the front of the process cartridge 20 using a screw (not illustrated). The pair of face plates 7 (one at the front is not illustrated) supports the photoconductor 10 and the developing roller 28 at each end thereof in the rotating shaft direction in a rotatable manner, and functions as a positioning member that fixes a distance between a rotating shaft (not illustrated) of the photoconductor 10 and the rotating shaft 28*a* (refer to FIG. 1) of the developing roller 28.

The face plate 7 is integrally formed with appropriate resin, and contributes to reduce the size (described later), weight, and cost. As illustrated in FIG. 7, a photoconductor supporting hole 7*a* that supports the rotating shaft (not illustrated) of the photoconductor 10 and a developing roller supporting hole 7*b* that supports the rotating shaft 28*a* of the developing roller 28 are formed on the face plate 7. A main body input gear shaft escape hole 7*c* and a rotating shaft escape hole 7*d* for the second conveying screw are formed on the face plate 7. The main body input gear shaft escape hole 7*c* escapes so as not to be in contact with the main body input gear shaft 2*c* that supports the main body input gear 2 in a rotatable manner. The rotating shaft escape hole 7*d* for the second conveying screw escapes so as not to be in contact with the rotating shaft 24*a* of the second conveying screw 24. The main body input gear shaft escape hole 7*c* and the rotating shaft escape hole 7*d* are formed on the face plate 7, so that the distance between the rotating shaft (not illustrated) of the photoconductor 10 and the rotating shaft 28*a* of the developing roller 28 can be fixed without any trouble. A positioning pin 7*e* is formed on the face plate 7. The positioning pin 7*e* is fitted into a positioning hole on a side plate (not illustrated) of the apparatus main body 106 to be a sub-reference for positioning when the process cartridge 20 occupies the mounting position.

The following describes positioning and assembling of the face plate 7 with respect to the cartridge frame 9. The face plate 7 is fastened and fixed to the cartridge frame 9 with the screw 31 using the photoconductor supporting hole 7*a* supporting the rotating shaft (not illustrated) of the photoconductor 10 as a main reference and a boss (not illustrated) provided to the cartridge frame 9 as the sub-reference. The face plate 7 is fastened and fixed to the cartridge frame 9 with the screw 31 to perform positioning using the developing roller supporting hole 7*b* supporting the rotating shaft 28*a* of the developing roller 28 as the main reference and a boss (not illustrated) provided to the face plate 7 as the sub-reference.

As illustrated in FIGS. 4 and 6, the rear end part of the rotating shaft 24*a* of the second conveying screw 24 is supported by the bearing 8 in a rotatable manner. The bearing 8 is arranged between the outer surface 9*a* of the cartridge frame 9 and the second conveying screw gear 5, fixed to the cartridge frame 9, and supports the rotating shaft 24*a* of the second conveying screw 24 in a rotatable manner. The bearing 8 includes a large-diameter part 8*a* and a small-diameter part 8*b*, which are integrally formed with polyacetal resin (POM) or polyamide resin (PA) having small friction resistance with respect to the rotating shaft 24*a*, a lubricating function, and durability, for example. As described above, the bearing 8 includes the large-diameter part 8*a* and the small-diameter part 8*b* to form a substantially L-shape in a sectional view of an upper half and a lower half in the drawing. A reason why the bearing 8 is formed of the large-diameter part 8*a* and the small-diameter part 8*b* is as follows. That is, as illustrated in FIGS. 4 and 6, the large-diameter part 8*a* corresponding to an inner part of the rotating shaft 24*a* should be enlarged to mount a sealing member 25 for preventing toner leakage from between the bearing 8 and the rotating shaft 24*a* inside the developing device 12 on a sealing member attaching groove 8*f* of the large-diameter part 8*a*. This is because the rotating shaft escape hole 7*d* formed on the face plate 7 through which an outer diameter portion of the small-diameter part 8*b* of the bearing 8 supporting part of the rotating shaft 24*a* close to the second conveying screw gear 5 escapes is required to be as small as possible to reduce the size of the face plate 7.

A fixing target outer peripheral surface 8*e* that is press-fitted (that is, pressed in by application of pressure) in a bearing fixing hole 9*b* of the cartridge frame 9 to be fixed is formed on the large-diameter part 8*a*. A rotating shaft supporting part 8*g* described later is formed in the small-diameter part 8*b*. Between the large-diameter part 8*a* and the small-diameter part 8*b*, a ring-shaped flange 8*h* is formed to extend in a centrifugal direction orthogonal to the rotating shaft 24*a*. The flange 8*h* serves as a stopper when the bearing 8 is press-fitted in the bearing fixing hole 9*b* of the cartridge frame 9 to be attached and fixed. A recessed part (not illustrated) that is recessed to be a D-shape in a sectional view is formed on part of an outer peripheral surface of the large-diameter part 8*a* of the bearing 8. When the bearing 8 is attached to the bearing fixing hole 9*b* of the cartridge frame 9, the recessed part of the bearing 8 is engaged with a recessed part (not illustrated) that is recessed to be a D-shape formed on the bearing fixing hole 9*b* of the cartridge frame 9 to prevent the bearing 8 from rotating.

The sealing member attaching groove 8*f* is formed on the large-diameter part 8*a* of the bearing 8, the sealing member attaching groove 8*f* having a shape of an entire circumference recessed part as a developer sealing part for sealing the developer in the developing device 12. The ring-shaped sealing member 25 is attached to the sealing member attaching groove 8*f*. The sealing member 25 is attached to the sealing member attaching groove 8*f* with a predetermined lap margin between the sealing member 25 and the outer peripheral surface of the rotating shaft 24*a*. Examples of the sealing member 25 preferably include a sealing member made of polyurethane rubber (hardness is about 92 Hs: JIS K6253)

that is a flexible, slidable, and elastic material having a function of preventing leakage and scattering of the developer.

The bearing 8 also includes the rotating shaft supporting part 8*g* formed thereon serving as a rotating shaft supporting part that supports the rotating shaft 24*a* of the second conveying screw 24 in a rotatable manner. The rotating shaft supporting part 8*g* is not formed across the entire length of the bearing 8 in the front and rear direction Y, and is formed from part of the large-diameter part 8*a* to the entire small-diameter part 8*b*. In other words, the rotating shaft supporting part 8*g* is formed in a minimum required range to secure accuracy of a position and a dimension of the second conveying screw 24 via the rotating shaft 24*a*. A non-contact part 8*c* escaping without being in contact with the rotating shaft 24*a* is formed at the left part of the large-diameter part 8*a* in the drawing. The non-contact part 8*c* is formed on part of the bearing 8 to reduce a rotational load on the rotating shaft 24*a* according to contact or sliding contact between the rotating shaft 24*a* and the rotating shaft supporting part 8*g*. The term "sliding contact" means being in contact in a slidable manner.

A clearance 33 is secured between the rotating shaft escape hole 7*d* of the face plate 7 and an outer peripheral surface of the small-diameter part 8*b*. In addition, clearances are secured to prevent an inner surface of the face plate 7 from being in contact with an inner end face 5*a* of the second conveying screw gear 5, and prevent an outer surface of the face plate 7 from being in contact with an outer end face of the flange 8*h*.

As illustrated in FIG. 6A, the rotating shaft supporting part 8*g* is formed to extend outside the face plate 7 along the entire range of the small-diameter part 8*b*, and the bearing 8 is arranged and shaped so that an outer end face 8*d* of the rotating shaft supporting part 8*g* is brought into contact with the inner end face 5*a* of the second conveying screw gear 5. It is confirmed that even when the outer end face 8*d* of the rotating shaft supporting part 8*g* is in contact with the inner end face 5*a* of the second conveying screw gear 5, a function of stirring/conveying the developer of the second conveying screw 24 is not affected because the bearing 8 is formed of the material described above.

The rotating shaft supporting part 8*g* is not limited to the example in FIG. 6A, and may be formed within a range of thickness t of the face plate 7 that is the entire range of the small-diameter part 8*b*. The bearing 8 may be arranged and shaped so that the outer end face 8*d* of the rotating shaft supporting part 8*g* comes close to (for example, 1 mm or less) the inner end face 5*a* of the second conveying screw gear 5.

Figure 8:
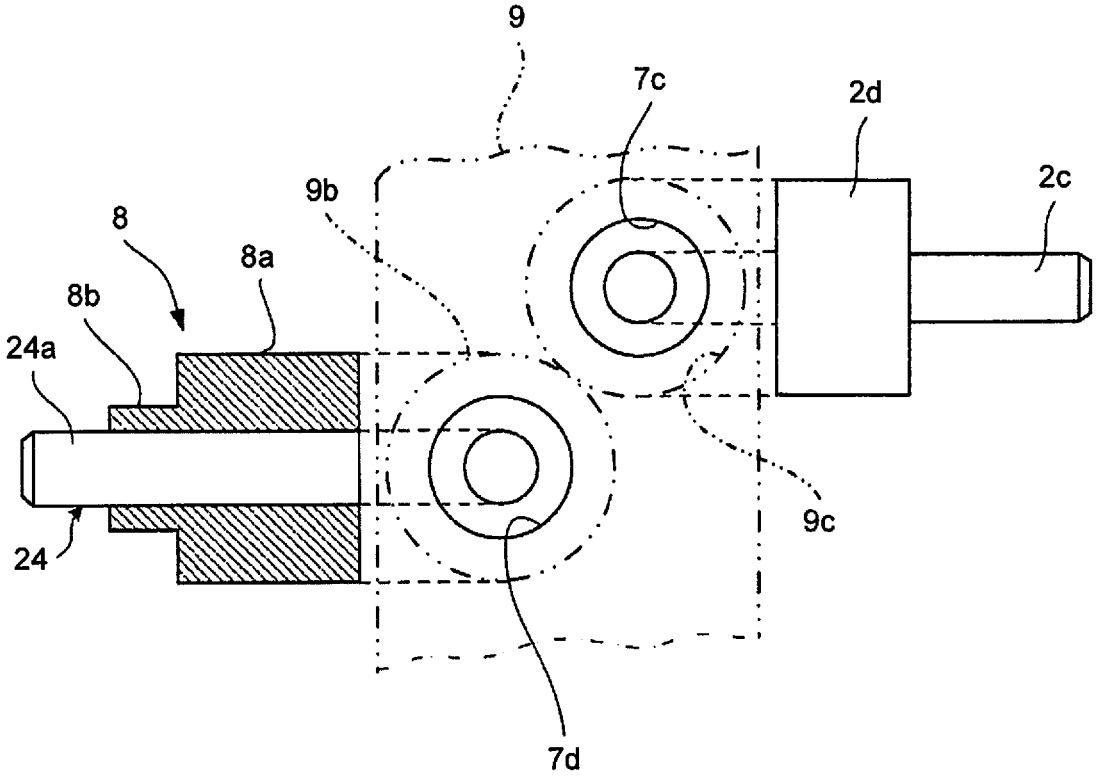
FIG. 8 is a schematic explanatory diagram for explaining a mounting/positional relation among the rotating shaft of the second conveying screw, the bearing, a main body input gear shaft, a main body input gear shaft escape hole and a rotating shaft escape hole formed on the face plate, and the cartridge frame.

With reference to FIG. 8, the following describes a mounting/positional relation among the rotating shaft 24*a*, the bearing 8, the main body input gear shaft 2*c*, the main body input gear shaft escape hole 7*c* and the rotating shaft escape hole 7*d* formed on the face plate 7, and the cartridge frame 9.

As described above, the large-diameter part 8*a* of the bearing 8 is press-fitted into and fixed to the bearing fixing hole 9*b* of the cartridge frame 9 represented by a chain double-dashed line. On the other hand, the main body input gear shaft 2*c* made of metal needs to be rigidly fixed to the cartridge frame 9 to implement the function thereof, so that a large-diameter shaft part 2*d* having a diameter larger than that of the main body input gear shaft 2*c* is formed to be press-fitted into and fixed to a shaft fixing hole 9*c* of the cartridge frame 9. The large-diameter part 8*a* and the large-diameter shaft part 2*d* should be fixed to the cartridge frame 9 so as not to interfere with each other, and the rotating shaft 24*a* should be made to protrude rearward from the rotating shaft escape hole 7*d* of the face plate 7 while being supported in a rotatable manner. In the downsized process cartridge 20 according to the embodiment, a distance between the rotating shaft (not illustrated) of the photoconductor 10 and the rotating shaft 28*a* (not illustrated) of the developing roller 28 and a distance between the rotating shaft 28*a* (not illustrated) of the developing roller 28 and the rotating shaft 24*a* are set to be as small as possible within a range of not having an adverse effect on functions thereof. Corresponding to this, the face plate 7 is also downsized. In the downsized face plate 7, as illustrated in FIG. 7, the main body input gear shaft escape hole 7*c* is arranged to be close to the rotating shaft escape hole 7*d*, and the main body input gear shaft escape hole 7*c* and the rotating shaft escape hole 7*d* cannot be upsized any more. If the face plate 7 only serves to escape with the main body input gear shaft escape hole 7*c* and the rotating shaft escape hole 7*d*, it is sufficient to form openings larger than required to escape the main body input gear shaft escape hole 7*c* and the rotating shaft escape hole 7*d*. However, such a configuration may hinder strength and rigidity required for retaining a positioning function as the face plate, so that an arrangement relation as illustrated in FIG. 8 is employed.

With reference to FIG. 6A, the following describes a relation among the bearing 8, the second conveying screw gear 5, the outer surface 9*a* of the cartridge frame 9, and the rotating shaft 24*a*. Assuming that the small-diameter part 8*b* of the bearing 8 is not mounted on the rotating shaft 24*a* between the second conveying screw gear 5 and the outer surface 9*a* of the cartridge frame 9, it leads to a cantilever-supported state in which the second conveying screw gear 5 fixed to the distal end of the rotating shaft 24*a* is not supported by any component. In this state, the distal end of the protruding rotating shaft 24*a* is not supported and a certain gap is provided between the outer surface 9*a* of the cartridge frame 9 and the second conveying screw gear 5. Accordingly, when the rotating shaft 24*a* is rotated together with the second conveying screw gear 5, unsteadiness (in longitudinal direction) is caused between the second conveying screw gear 5 and the rotating shaft 24*a*, which adversely affects the function of the second conveying screw 24 formed with resin at low cost.

The unsteadiness and whirling can be prevented if the material of the rotating shaft is changed to one having more strength and rigidity (for example, changed from resin to metal such as iron material), or downsizing of the apparatus is given up (by supporting the distal end of the rotating shaft), for example. However, in this case, the apparatus may be unexpectedly upsized or the cost may be increased instead.

The embodiment employs the configuration in FIG. 6A, so that the unsteadiness between the second conveying screw gear 5 and the rotating shaft 24*a* is suppressed when the rotating shaft 24*a* of the second conveying screw 24 made of resin is rotated together with the second conveying screw gear 5. This has been confirmed by making a prototype. This can prevent an adverse effect on the function of the second conveying screw gear 5 in advance.

If the unsteadiness described above is caused, there is a risk that the unsteadiness is transmitted to the developing roller gear 3 through the small-diameter gear 2*b* of the main body input gear 2 meshing with the second conveying screw gear 5 illustrated in FIG. 5 and the like to adversely affect the developing roller 28 in some cases. However, suppression of the unsteadiness can remove the risk.

On the other hand, as described in the background of the invention, on the face plates serving as a positioning member that couple a photoconductor unit and a developing unit, it is preferable that the developing roller shaft, the photoconductor shaft, and a portion that fixes a posture of the process cartridge are on the same plane in terms of accuracy of components and the like. For example, a driving component such as a gear is inside the face plate (for example, refer to FIG. 8 in Japanese Patent Application Laid-open No. 2007-047720), the face plate should be correspondingly shifted outside in the entire area, so that an unnecessary space is occupied and the size of the apparatus is undesirably increased.

According to the embodiment, the arranging/mounting relation specific to the members described above makes it possible to reduce the size of the process cartridge 20, reduce the size of the image forming apparatus 100 accordingly, and reduce the cost. In addition, the following effect can be obtained. That is, the face plate 7 serving as the positioning member is arranged between the outer surface 9*a* of the cartridge frame 9 and the second conveying screw gear 5 via the bearing 8. Accordingly, the face plate 7 is not arranged outside the second conveying screw gear 5, so that the face plate 7 serving as the positioning member does not occupy an unnecessary space, and the process cartridge 20 that prevents the apparatus from being upsized can be provided.

First Modification

Figure 9:
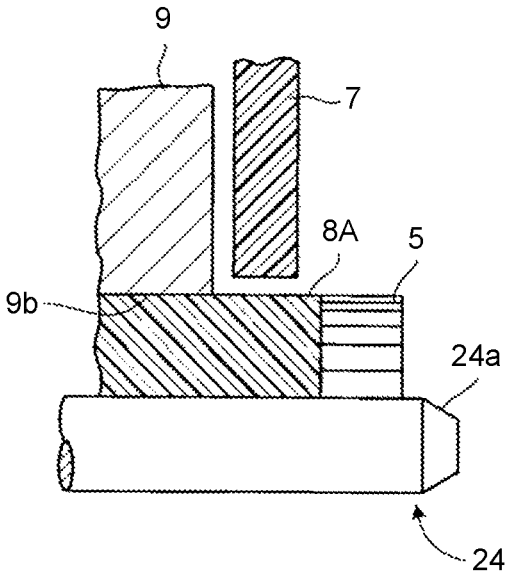
FIG. 9 is a partially enlarged schematic sectional view of an upper half of the configuration of the principal part according to a first modification.

With reference to FIG. 9, the following describes a first modification of the embodiment illustrated in FIGS. 1 to 8. FIG. 9 is a partially enlarged schematic sectional view of an upper half of the configuration of the principal part according to the first modification.

The first modification is different from the embodiment illustrated in FIGS. 1 to 8 mainly in that a bearing 8A is used instead of the bearing 8. The configuration other than the point of difference is the same as that in the embodiment, and the arrangement relation among basic members is the same. The bearing 8A is different from the bearing 8 in that a two-stage structure including the large-diameter part 8*a* and the small-diameter part 8*b* is changed to have the same outer peripheral surface shape. The bearing 8A is press-fitted and fixed to the bearing fixing hole 9*b* of the cartridge frame 9.

According to the first modification, with the arranging/mounting relation specific to the members described above, the same effect as that in the embodiment can be obtained without causing the size of the process cartridge to increase and the size of the image forming apparatus to increase, accordingly.

Second Modification

Figure 10:
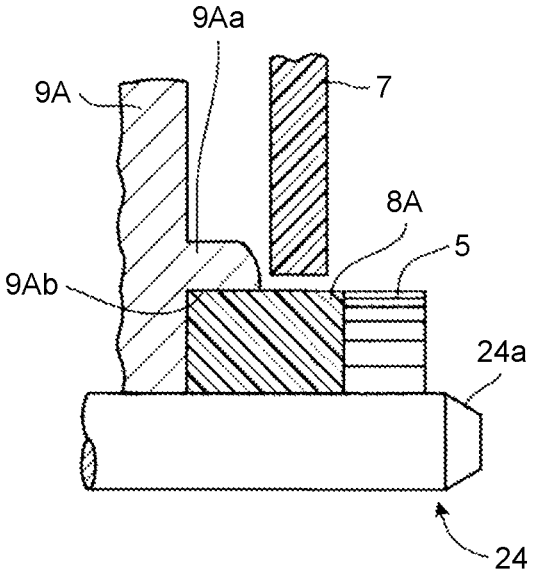
FIG. 10 is a partially enlarged schematic sectional view of the upper half of the configuration of the principal part according to a second modification.

With reference to FIG. 10, the following describes a second modification of the embodiment illustrated in FIGS. 1 to 8. FIG. 10 is a partially enlarged schematic sectional view of the upper half of the configuration of the principal part according to the second modification.

The second modification is different from the embodiment illustrated in FIGS. 1 to 8 mainly in that the bearing 8A is used instead of the bearing 8, and a cartridge frame 9A is used instead of the cartridge frame 9. The configuration other than the point of difference is the same as that in the embodiment, and the arrangement relation among the basic members is the same. The cartridge frame 9A is different from the cartridge frame 9 in that a bearing fixing part 9Aa is integrally formed to protrude on an outer surface of the cartridge frame 9A. A bearing fixing surface 9Ab to which the outer peripheral surface of the bearing 8A is press-fitted in and fixed is formed on the bearing fixing part 9Aa.

According to the second modification, with the arranging/mounting relation specific to the members described above, the same effect as that in the embodiment can be obtained without causing the size of the process cartridge to increase and the size of the image forming apparatus to increase, accordingly.

The preferred embodiment and the like according to the embodiment have been described above. However, the present invention is not limited to the specific embodiment, and can be variously modified or changed within the gist of the present invention described in claims unless otherwise specifically limited. That is, the components exemplified in the embodiment, the modification, and the like described above may be appropriately combined. For example, an image forming apparatus to which the present invention is applied is not limited to the image forming apparatus of the above-described type, and may be an image forming apparatus of another type.

That is, the image forming apparatus is not limited to the above-described image forming apparatus, and may be a color image forming apparatus of a tandem-type intermediate transfer system including four process cartridges corresponding to toner of four colors: yellow, magenta, cyan, and black.

The process cartridge is not limited to the one described above. Alternatively, a rotating member may be arranged on a charging device or a cleaning device constituting the process cartridge, for example. Specifically, the rotating member may be a charging roller that is rotationally driven by the charging device, or may be a developer conveying screw that discards or circulates the toner in a rotationally driven cleaning device, for example.

The technical idea of the present invention can also be applied to an image forming apparatus and an attaching/detaching unit in which a developing device or a developing unit, a charging device or a charging unit, a cleaning device or a cleaning unit, and the like are detachably mounted on an apparatus main body of the image forming apparatus with a member similar to a positioning member.

According to an embodiment, a positioning member is arranged between a gear and an outer surface of a housing frame via a bearing, so that the positioning member is not arranged outside of the gear and thus a process cartridge that can prevent the size of the apparatus from increasing can be provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A process cartridge including at least an image bearer and a developing device among the image bearer, a charging device, the developing device, and a cleaning device in an integral manner, and that is detachably mounted on an apparatus main body of an image forming apparatus, the process cartridge comprising:

a developer bearer, arranged opposed to the image bearer in the developing device and rotatable in a certain direction while bearing a developer;

a positioning member that supports the image bearer and the developer bearer at respective ends thereof in a rotating shaft direction in a rotatable manner, and fixes a distance between a rotating shaft of the image bearer and a rotating shaft of the developer bearer;

a rotating member arranged on the developing device;

a rotating shaft arranged on the rotating member, and including a part in a longitudinal direction protruding from an outer surface of a housing frame of the process cartridge;

a gear, arranged at a distal end of the protruding rotating shaft, to transmit a rotational driving force transmitted from the apparatus main body to the rotating member; and a bearing, arranged between the positioning member and the gear and fixed to the housing frame, that supports the rotating shaft in a rotatable manner.

2. The process cartridge according to claim 1, wherein the rotating member is a conveying member, arranged in the developing device, to rotationally convey a developer housed in the developing device.

3. The process cartridge according to claim 1, further comprising:

an input gear, arranged on the outer surface via a shaft in a rotatable manner, configured to mesh with the gear to transmit the rotational driving force to the developer bearer and the conveying member.

4. The process cartridge according to claim 1, wherein the bearing comprises a part that seals the developer in the developing device and a rotating shaft supporting part that supports the rotating shaft.

5. The process cartridge according to claim 4, wherein the rotating shaft supporting part is formed to extend to within a range of a thickness of the positioning member or extend outside the positioning member, and an outer end of the rotating shaft supporting part and an inner end of the gear are arranged to be in contact or close to each other.

6. The process cartridge according to claim 4, wherein a clearance is provided to the positioning member so as not to be in contact with the rotating shaft supporting part.

7. The process cartridge according to claim 1, wherein the positioning member is attached to an outer surface of the housing frame.

8. The process cartridge according to claim 1, wherein at least one of the rotating member, the rotating shaft, the bearing, and the gear is formed of resin.

9. The process cartridge according to claim 1, wherein the developing device causes toner in the developer including the toner and a carrier to adhere to a latent image formed on a surface of the image bearer for development.

10. An image forming apparatus comprising the process cartridge according to claim 1.

* * * * *